US010834495B2

(12) United States Patent
Lee et al.

(10) Patent No.: US 10,834,495 B2
(45) Date of Patent: Nov. 10, 2020

(54) ELECTRONIC DEVICE INCLUDING SPEAKER

(71) Applicant: Samsung Electronics Co., Ltd., Gyeonggi-do (KR)

(72) Inventors: Byounghee Lee, Seoul (KR); Changshik Yoon, Seoul (KR); Sunyoung Lee, Gyeonggi-do (KR); Joonrae Cho, Seoul (KR); Myoungsung Sim, Gyeonggi-do (KR); Seongkwan Yang, Gyeonggi-do (KR); Hochul Hwang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/324,599

(22) PCT Filed: Aug. 7, 2017

(86) PCT No.: PCT/KR2017/008499

§ 371 (c)(1),
(2) Date: Feb. 11, 2019

(87) PCT Pub. No.: WO2018/038420

PCT Pub. Date: Mar. 1, 2018

(65) Prior Publication Data

US 2019/0222921 A1 Jul. 18, 2019

(30) Foreign Application Priority Data

Aug. 23, 2016 (KR) ..... 10-2016-0107196

(51) Int. Cl.
*H04R 25/00* (2006.01)
*H04R 1/28* (2006.01)
(Continued)

(52) U.S. Cl.
CPC ..... *H04R 1/28* (2013.01); *H04R 1/02* (2013.01); *H04R 1/2842* (2013.01);
(Continued)

(58) Field of Classification Search
CPC ..... H04R 1/28; H04R 1/44; H04R 29/001; H04R 2499/11; H04R 1/02; H04R 1/2842; H04R 1/2849
(Continued)

(56) References Cited

U.S. PATENT DOCUMENTS 7,587,043 B2 * 9/2009 Nguyen ..... H04M 1/03 379/433.02
10,356,498 B2 * 7/2019 Yoon ..... H04R 1/345
(Continued)

FOREIGN PATENT DOCUMENTS

JP 2007-096893 A 4/2007
JP 2007-318396 A 12/2007
(Continued)

*Primary Examiner* — Phylesha Dabney
(74) *Attorney, Agent, or Firm* — Cha & Reiter, LLC.

(57) ABSTRACT

According to various examples of the present invention, an electronic device including a speaker can comprise: a first housing; a second housing located in an inner space of the first housing and accommodating a speaker; a separation means for separating the inside of the second housing into a first space opened to the outside of the second housing in the front surface direction of the speaker and a second space in the rear surface direction of the speaker; and opening formed in the separation means and allowing the first space to communicate with the second space; and a separation member coupled to the opening, and having a sound blocking function between the first space and the second space while enabling air permeation between the first space and the second space. Other examples are possible.

11 Claims, 17 Drawing Sheets

(51) Int. Cl.
*H04R 1/02* (2006.01)
*H04R 29/00* (2006.01)
*H04R 1/44* (2006.01)

(52) U.S. Cl.
CPC ..... *H04R 1/2876* (2013.01); *H04R 1/44* (2013.01); *H04R 29/001* (2013.01); *H04R 2499/11* (2013.01)

(58) Field of Classification Search
USPC ..... 381/351
See application file for complete search history.

(56) References Cited

U.S. PATENT DOCUMENTS

| | | | | |
|---|---|---|---|---|
| 10,375,469 | B2 * | 8/2019 | Qin | H04R 1/025 |
| 2005/0014537 | A1 * | 1/2005 | Gammon | H04M 1/035 455/575.1 |
| 2005/0077102 | A1 * | 4/2005 | Banter | H04R 1/023 181/149 |
| 2007/0178949 | A1 | 8/2007 | Sato et al. | |
| 2015/0163572 | A1 | 6/2015 | Weiss et al. | |

FOREIGN PATENT DOCUMENTS

| | | | |
|---|---|---|---|
| JP | 2013-197818 | A | 9/2013 |
| KR | 10-2015-0112468 | A | 10/2015 |

* cited by examiner

| COMPARISON ITEM | REF | IMPROVED |
|---|---|---|
| SPL (DB) (0.8, 1, 1.2, 1.5KHZ, AVERAGE) | 79.0 | 78.9 |
| SOUND PRESSURE DIFFERENCE (DB) IN LOW BAND (400~1000HZ) | Ref. | +0.1 |
| SOUND PRESSURE DIFFERENCE (DB) IN MID/HIGH BAND (1.25~8KHZ) | Ref. | −0.3 |

ELECTRONIC DEVICE INCLUDING SPEAKER

CLAIM OF PRIORITY

This application is a National Phase Entry of PCT International Application No. PCT/KR2017/008499, which was filed on Aug. 7, 2017 and claims a priority to Korean Patent Application No. 10-2016-0107196, which was filed on Aug. 23, 2016, the contents of which are incorporated herein by reference.

TECHNICAL FIELD

Various embodiments of the present invention relate to an electronic device including a speaker.

BACKGROUND ART

Recently, electronic devices such as a smart phone, a tablet PC, a desktop PC, a portable multimedia player (PMP), an MP3 player, or a wearable device have been widely popularized, and users can use various contents through such electronic devices.

As the activity range of users using electronic devices becomes wider, the users want to use various contents in various environments.

However, the electronic devices are also exposed to various environments, and thus some problems may be caused in executing functions of the electronic devices.

One of such problems may be a loss of a speaker function caused by variations in environments such as the change of an atmospheric pressure or the penetration of moisture. Specifically, because the electronic device includes a speaker diaphragm for generating a sound and a sound emission opening for emitting a sound, deformation of the diaphragm due to the change of an atmospheric pressure may cause an abnormal sound, and the sound emission opening may cause the penetration of moisture or the occurrence of condensation in internal components of the electronic device.

DISCLOSURE OF INVENTION

Technical Problem

Various embodiments of the present invention are to provide an electronic device including a speaker which is not affected by variations in external environments.

Solution to Problem

According to various embodiments of the present invention, an electronic device may comprise a first housing; a second housing disposed in an inner space of the first housing and having a speaker hole; a separator for separating an inner space of the second housing into a first space and a second space, wherein the separator includes a first separator and a speaker as a second separator, wherein the first space is spatially connected to the outside of the second housing through the speaker hole, wherein a diaphragm of the speaker is exposed to the first space, wherein the first separator includes an opening formed therein to connect the first and second spaces, and wherein a material allowing air permeation and soundproof is attached to the opening.

Advantageous Effects of Invention

According to various embodiments, an electronic device includes a speaker provided with a hole, which can prevent a change of atmospheric pressure inside the electronic device from affecting a diaphragm of the speaker and thereby preventing a loss of a speaker function.

According to various embodiments, an electronic device includes a speaker provided with a hole and a material attached to the hole, the material preventing moisture from permeating the speaker through the hole.

According to various embodiments, an electronic device includes a speaker having a hole with a material attached, the material preventing a speaker sound from being degraded in quality and volume.

MODE FOR THE INVENTION

Figure 1:
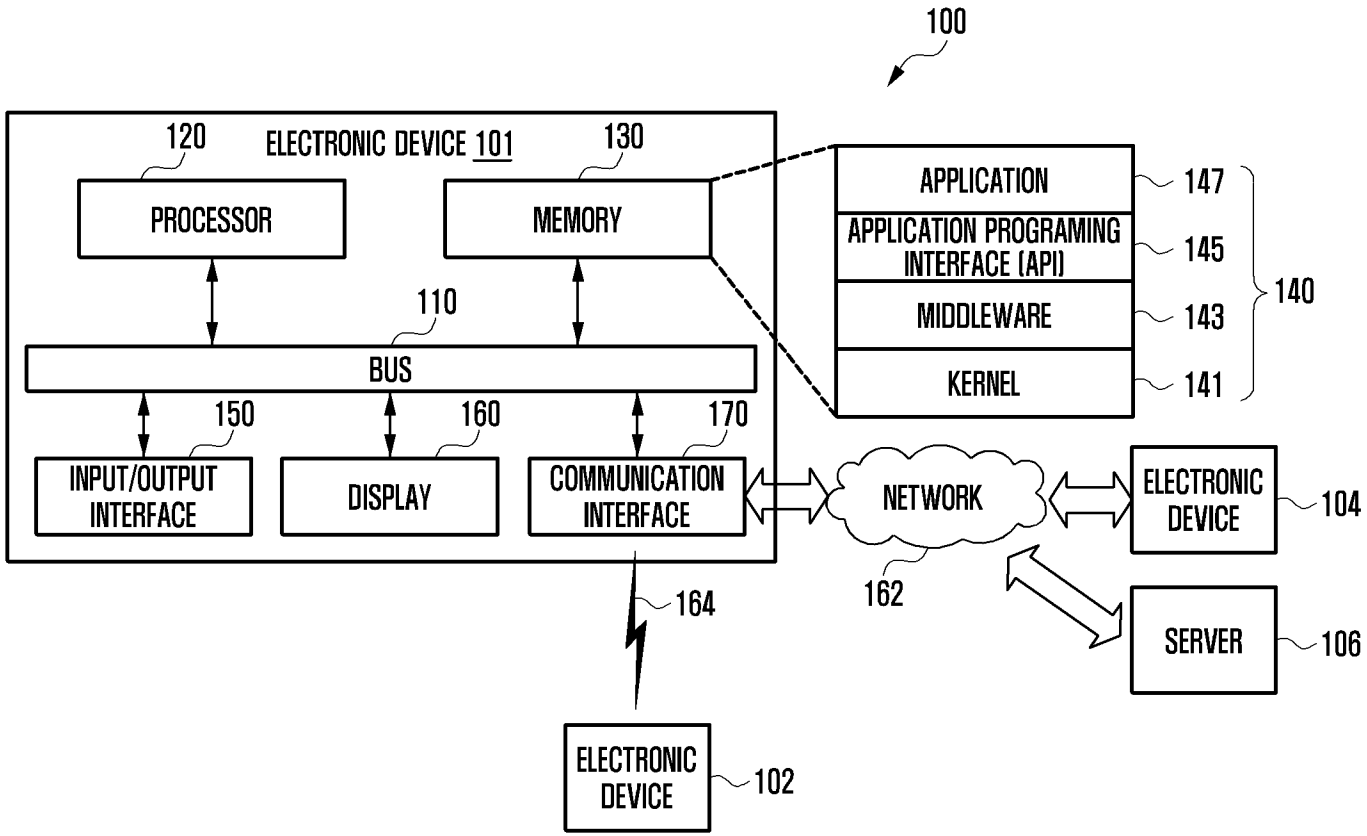
FIG. 1 is a block diagram illustrating an electronic device in a network environment according to various embodiments.

Hereinafter, various embodiments of the present document will be described with reference to the accompanying drawings. The various embodiments of the present disclosure are not limited to a specific implementation form and it should be understood that the present disclosure includes all changes and/or equivalents and substitutes included in the spirit and scope of various embodiments of the present disclosure. In connection with descriptions of the drawings, similar components are designated by the same reference numeral.

In this document, an expression such as "have," "may have," "comprise," or "may comprise" indicates existence of a corresponding characteristic (e.g., constituent element such as a numerical value, function, operation, or component) and does not exclude the presence of another characteristic.

In this document, an expression such as "A or B", "at least one of A or/and B", or "one or more of A or/and B" may include all possible combinations of together listed items. For example, "A or B," "at least one of A and B," or "one or more of A or B" may indicate all of (1) a case of including at least one A, (2) a case of including at least one B, and (3) a case of including both at least one A and at least one B.

In the present disclosure, expressions including ordinal numbers, such as "first" and "second," etc., may modify various elements. However, such elements are not limited by the above expressions. For example, the above expressions do not limit the sequence and/or importance of the elements. The above expressions are used merely for the purpose to distinguish an element from the other elements. For example, a first user device and a second user device indicate different user devices although both of them are user devices. For example, a first element could be termed a second element, and similarly, a second element could be also termed a first element without departing from the scope of the present disclosure.

In the case where a component is referred to as being "connected" or "accessed" to other component, it should be understood that not only the component is directly connected or accessed to the other component, but also there may exist another component between them. Meanwhile, in the case where a component is referred to as being "directly connected" or "directly accessed" to other component, it should be understood that there is no component therebetween. The terms used in the present disclosure are only used to describe specific various embodiments, and are not intended to limit the present disclosure. As used herein, the singular forms are intended to include the plural forms as well, unless the context clearly indicates otherwise. Singular forms are intended to include plural forms unless the context clearly indicates otherwise.

An expression "configured to" used in this document may be interchangeably used with, for example, "suitable for", "having the capacity to", "designed to", "adapted to", "made to", or "capable of" according to a situation. A term "configured to" does not always mean "specifically designed to" in hardware. Alternatively, in any situation, an expression "device configured to" may mean that the device is "capable of" being configured together with another device or component. For example, a "processor configured to perform phrases A, B, and C" may be a generic-purpose processor (e.g., CPU or application processor) that executes an exclusive processor (e.g., an embedded processor) for performing a corresponding operation or at least one software program stored at a memory device to perform a corresponding operation.

Terms used in this document are used for describing a specific embodiment and do not limit a range of another embodiment. Unless the context otherwise clearly indicates, words used in the singular include the plural, and the plural includes the singular. Terms used here including a technical or scientific term have the same meaning as that which may be generally understood by a person of common skill in the art. Terms defined in a general dictionary among terms used in this document may be analyzed as the same meaning as or a meaning similar to that in a context of related technology, and unless it is clearly defined in this document, the term is not analyzed as having an ideal or excessively formal meaning. In some cases, a term defined in this document cannot be analyzed to exclude the embodiments of this document.

An electronic device according to various exemplary embodiments of the present invention may be a device including a communication function. For example, the electronic device may include at least one of a smart phone, tablet personal computer (PC), mobile phone, video phone, e-book reader, desktop PC, laptop PC, netbook computer, personal digital assistant (PDA), portable multimedia player (PMP), MPEG 3 (MP3) player, mobile medical equipment, camera, wearable device (e.g., head-mounted-device (HMD) such as electronic glasses), electronic clothing, electronic bracelet, electronic necklace, electronic accessory, electronic tattoo, and smart watch.

In any embodiment, the electronic device may be a smart home appliance. The smart home appliance may include at least one of, for example, a television, digital video disk (DVD) player, audio device, refrigerator, air-conditioner, cleaner, oven, microwave oven, washing machine, air cleaner, set-top box, home automation control panel, security control panel, television box (e.g., Samsung HomeSync™, AppleTV™, or Google TV™), game console (e.g., Xbox™, PlayStation™), electronic dictionary, electronic key, camcorder, and electronic frame.

In another embodiment, an electronic device may include at least one of various medical devices (e.g., various portable medical measurement devices (blood sugar measurement device, heartbeat measurement device, blood pressure measurement device, or body temperature measurement device), magnetic resonance angiography (MRA) device, magnetic resonance imaging (MRI) device, computed tomography (CT) device, scanning machine, and ultrasonic wave device), navigation device, global positioning system (GPS) receiver, event data recorder (EDR), flight data recorder (FDR), vehicle infotainment device, ship electronic equipment (e.g., ship navigation device, gyro compass), avionics, security device, vehicle head unit, industrial or home robot, automatic teller's machine (ATM) of a financial institution, point of sales (POS) of a store, and Internet of things (e.g., bulb, various sensors, electricity or gas meter, sprinkler, fire alarm, thermostat, street light, toaster, exercise mechanism, hot water tank, heater, boiler).

According to any embodiment, the electronic device may include at least one of a portion of furniture or a building/structure, electronic board, electronic signature receiving device, projector, and various measurement devices (e.g., water supply, electricity, gas, or electric wave measurement device). In various embodiments, the electronic device may be a combination of one or more of the foregoing various devices. An electronic device according to any embodiment may be a flexible electronic device. Further, the electronic device according to an embodiment of this document is not limited to the foregoing devices and may include a new electronic device according to technology development.

In this document, the term "user" used in various embodiments may refer to a person who uses an electronic device or a device (for example, an artificial intelligence electronic device) which uses an electronic device.

FIG. 1 illustrates a network environment 100 including an electronic device 101 according to various embodiments of the present disclosure. The electronic device 101 includes a bus 110, a processor 120, a memory 130, a input/output interface 150, a display 160 and a communication interface 170. According to some embodiments, the electronic device 101 may omit at least one of the components, or may additionally comprise other components.

The bus 110 may be a circuit connecting the above described components 110 to 170 and transmitting communication (for example, a control message or data) between the above described components.

The processor 120 may include one or more of a central processing unit (CPU), an application processor (AP), or a communications processor (CP). The processor 120 may execute operations or data processing related to control and/or communicate at least one the other components of the electronic device (101).

The memory 130 may include volatile and/or non-volatile memory. For example, the memory 130 may store instructions or data related to at least one other component of the electronic device 101. According to one embodiment, the memory 130 may store software and/or programs 140. For example, the program 140 may include a kernel 141, a middleware 143, an application programming interface (API) 145, and/or an application program (or application)

147. At least one of the kernel 141, middleware 143, or API 145 may be referred to as an operating system.

For example, the kernel 141 controls or manages system resources (e.g., bus 110, processor 120, or memory 130, etc.) used for executing an operation or function implemented by the remaining other programming modules, for example, the middleware 143, the API 145, or the application 147. Further, the kernel 141 provides an interface for accessing individual components of the electronic device 101 from the middleware 143, the API 145, or the application 147 to control or manage the components.

The middleware 143 performs a relay function of allowing the API 145 or the application 147 to communicate with the kernel 141 to exchange data.

Further, in operation requests received from the application 147, the middleware 143 performs a control for the operation requests by using a method of assigning a priority. For example, the middleware 143 performs a control for the operation requests by using a method of assigning a priority by which system resources (for example, the bus 110, the processor 120, the memory 130 and the like) of the electronic device 100 can be used, to the application 147.

The API 145 is an interface by which the application 147 can control a function provided by the kernel 141 or the middleware 143 and includes, for example, at least one interface or function (for example, command) for a file control, a window control, image processing, or a character control.

The input/output interface 150 can receive, for example, a command and/or data from a user or external device, and transfer the received command and/or data to the components of the electronic device 101. The input/output interface 150 can output the received command and/or data to the components of the user or the external device.

The display 160 may include a display device such as a liquid crystal display (LCD), a light emitting diode (LED) display, an organic light emitting diode (OLED) display, or a microelectromechanical system (MEMS) display, or an electronic paper display. The display 160 may display various content (e.g., text, images, video, icons, and/or symbols, etc.) to a user. The display 160 may include a touch screen and may receive a touch, gesture, proximity, or hovering input using an electronic pen or a portion of a user's body.

The communication interface 170 connects communication between the electronic device 100 and the external device (e.g., electronic device 102, 104 or server 106). For example, the communication interface 170 may access a network 162 through wireless or wired communication to communicate with the external device (e.g., the second electronic device 104 or server 106).

The wireless communication may include, for example, at least one of LTE, LTE-A (LTE Advance), code division multiple access (CDMA), wideband CDMA (WCDMA), universal mobile telecommunications system (UNITS), WiBro System for Mobile Communications). According to one embodiment, the wireless communication may include, for example, at least one of wireless fidelity (WiFi), Bluetooth, Bluetooth low power (BLE), Zigbee, near field communication, Magnetic Secure Transmission, Frequency (RF), or body area network (BAN). According to one example, wireless communication may include Global navigation satellite system (GNSS).

The MST may generate a pulse in response to transmission data using an electromagnetic signal, and the pulse may generate a magnetic field signal. The electronic device 101 may transfer the magnetic field signal to a POS device, and the POS device may detect the magnetic field signal using an MST reader. The POS device may recover the data by converting the detected magnetic field signal to an electrical signal.

For example, the GNSS may be a Global Positioning System (GPS), a Global Navigation Satellite System (Glonass), a Beidou Navigation Satellite System (Beidou), or a Galileo, the European global satellite-based navigation system. Hereinafter, the term 'GPS' can be used interchangeably with the term 'GNSS' in this document. The wired communication may include, for example, at least one of a universal serial bus (USB), a high definition multimedia interface (HDMI), a recommended standard 232 (RS-232), a power line communication, or a plain old telephone service (POTS). The network 162 may include at least one of a telecommunications network, a computer network (e.g., LAN or WAN), the Internet, or a telephone network Each of the first and second external electronic devices 102 and 104 may be the same or a different kind of device as the electronic device 101. According to various embodiments, all or a portion of the operations performed in the electronic device 101 may be performed in another electronic device or multiple electronic devices (e.g., electronic devices 102, 104, or server 106). According to one embodiment, in the event that the electronic device 101 has to perform certain functions or services automatically or upon request, the electronic device 101 may request other devices to perform at least some of the functions associated therewith instead of performing the function or service itself. Other electronic devices (e.g., the electronic devices 102 and 104, or server 106) may execute the requested function or additional function and transmit the results to electronic device 101. The electronic device 101 can directly or additionally process the received result to provide the requested function or service. For this purpose, for example, cloud computing, distributed computing, or client-server computing technology may be used.

Figure 2:
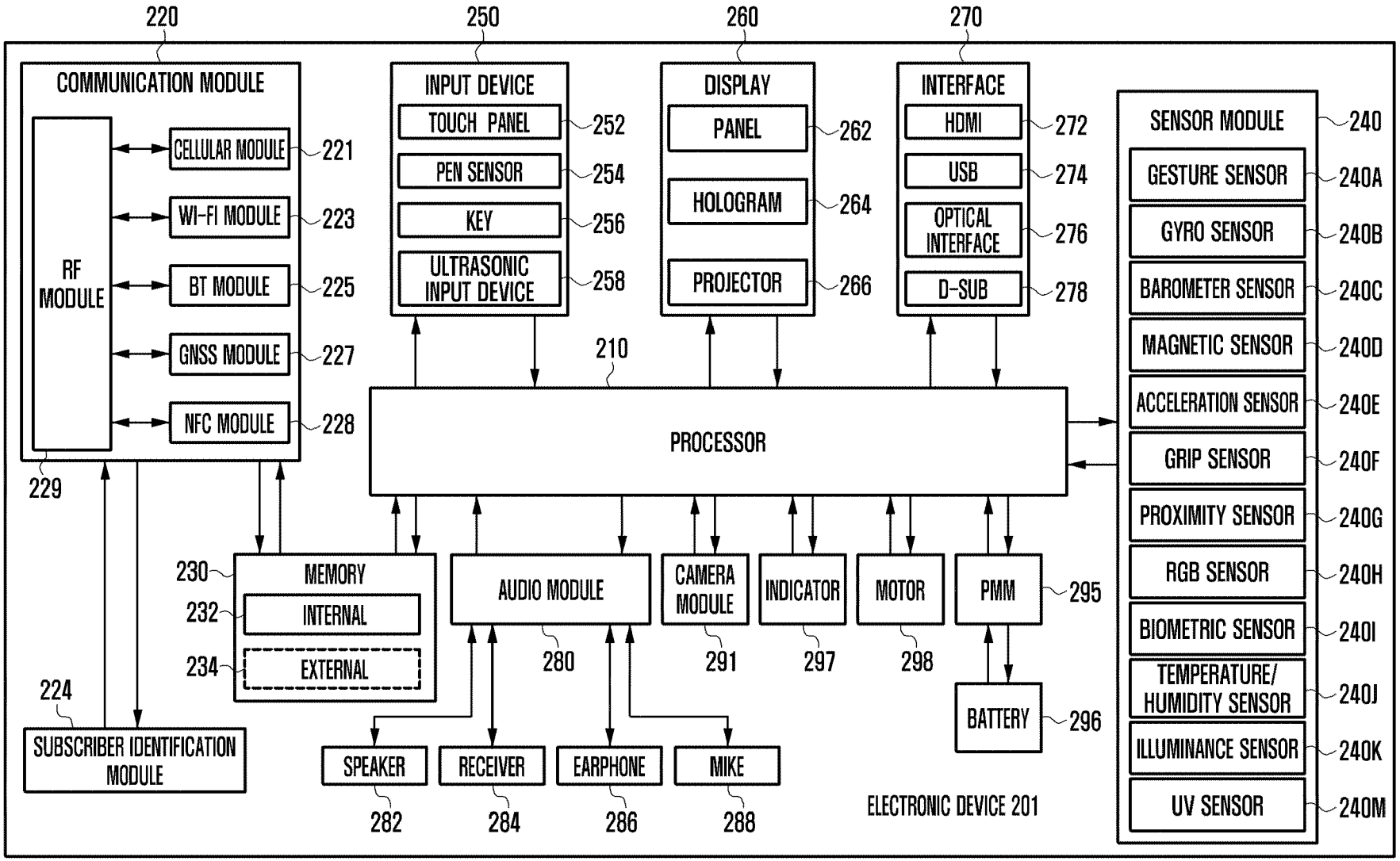
FIG. 2 is a block diagram of an electronic device according to various embodiments.

FIG. 2 is a block diagram of an electronic device 201 according to various embodiments of the present disclosure. The electronic device 201 may configure, for example, a whole or a part of the electronic device 101 illustrated in FIG. 1.

The electronic device 201 includes one or more processors (e.g., AP) 210, a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298.

For example, the processor 210 may operate an operating system (OS) or an application program to control a plurality of hardware or software components connected to the processor 210, and may perform various data processing and operations. The processor 210 may be implemented by, for example, a system on chip (SoC). According to an embodiment, the processor 210 may further include a graphics processing unit (GPU) and/or an image signal processor. The processor 210 may include at least some of the components shown in FIG. 2 (e.g., cellular module 221). The processor 210 may load and process instructions or data received from at least one of the other components (e.g., non-volatile memory) and store the processed data in non-volatile memory.

May have the same or similar configuration as communication module 220 (e.g., communication interface 170). The communication module 220 may include, for example, a cellular module 221, a WiFi module 223, a Bluetooth module 225, a GNSS module 227, an NFC module 228 and an RF module 229 have.

The cellular module 221 may provide, for example, voice calls, video calls, text services, or Internet services through a communication network. According to an embodiment, the cellular module 221 may distinguish and authenticate the electronic device 201 within the communication network by using the subscriber identity module (e.g., a SIM card) 224. According to an embodiment, the cellular module 221 performs at least some of the functions which can be provided by the processor 210. According to one embodiment, the cellular module 221 may include a communications processor (CP).

At least some (e.g., two or more) of the cellular module 221, the WiFi module 223, the Bluetooth module 225, the GNSS module 227, or the NFC module 228 may be included in one integrated chip (IC) or IC package according to one embodiment. The RF module 229 transmits/receives data, for example, an RF signal.

The RF module 229 may include, for example, a transceiver, a Power Amp Module (PAM), a frequency filter, a Low Noise Amplifier (LNA) or the like. According to another embodiment, at least one of the cellular module 221, the WiFi module 223, the Bluetooth module 225, the GNSS module 227, or the NFC module 228 transmits/receives an RF signal through a separate RF module.

The SIM card 224 is a card including a Subscriber Identification Module or an embedded SIM. The SIM card 224 includes unique identification information (for example, Integrated Circuit Card IDentifier (ICCID)) or subscriber information (for example, International Mobile Subscriber Identity (IMSI).

The memory 230 (for example, memory 130) may include an internal memory 232 or an external memory 234. The internal memory 232 may include, for example, at least one of a volatile memory (for example, a dynamic Random Access Memory (DRAM), a static RAM (SRAM), a synchronous dynamic RAM (SDRAM), and the like), and a non-volatile Memory (for example, a one time programmable Read Only Memory (OTPROM), a programmable ROM (PROM), an erasable and programmable ROM (EPROM), an electrically erasable and programmable ROM (EEPROM), a mask ROM, a flash ROM, a NAND flash memory, a hard drive, a solid state drive (SSD).

The external memory 234 may include a flash drive, for example, a Compact Flash (CF), a Secure Digital (SD), a Micro Secure Digital (Micro-SD), a Mini Secure Digital (Mini-SD), an extreme Digital (xD), a multimedia card (MMC), or a memory stick. The external memory 234 may be functionally connected to the electronic device 201 through various interfaces.

The sensor module 240 measures a physical quantity or detects an operation state of the electronic device 201, and converts the measured or detected information to an electronic signal.

The sensor module 240 may include, for example, at least one of a gesture sensor 240A, a gyro sensor 240B, an atmospheric pressure (barometric) sensor 240C, a magnetic sensor 240D, an acceleration sensor 240E, a grip sensor 240F, a proximity sensor 240G, a color sensor 240H (for example, Red, Green, and Blue (RGB) sensor) 240H, a biometric sensor 240I, a temperature/humidity sensor 240J, an illumination (light) sensor 240K, and a Ultra Violet (UV) sensor 240M. Additionally or alternatively, the sensor module 240 may include, for example, a E-nose sensor, an electromyography (EMG) sensor, an electroencephalogram (EEG) sensor, an electrocardiogram (ECG) sensor, an Infra-Red (IR) sensor, an iris sensor, a fingerprint sensor (not illustrated), and the like. The sensor module 240 may further include a control circuit for controlling one or more sensors included in the sensor module 240. According to some embodiments, to control the sensor module 240 while the processor 210 is in the sleep state, the electronic device 201 further includes a processor configured as part of the processor 210 or a processor that is separately configured from the processor 210.

The input device 250 may include, for example, a touch panel 252, a (digital) pen sensor 254, a key 256, and an ultrasonic input device 258. For example, the touch panel 252 may recognize a touch input in at least one type of a capacitive type, a resistive type, an infrared type, and an acoustic wave type. The touch panel 252 may further include a control circuit. The touch panel 252 may further include a tactile layer. In this event, the touch panel 252 provides a tactile reaction to the user.

For example, the (digital) pen sensor 254 may be part of the touch panel or may include a separate recognition sheet. The key 256 may include, for example, a physical button, an optical key, or a keypad. The ultrasonic input device 258 is a device which can detect an acoustic wave by a microphone (for example, microphone 288) of the electronic device 200 through an input means generating an ultrasonic signal to identify data and can perform wireless recognition.

The display 260 (for example, display 160) includes a panel 262, a hologram device 264, and a projector 266. The panel 262 may be implemented to be, for example, flexible, transparent, or wearable. The panel 262 may be configured by the touch panel 252 and one module. According to an embodiment, the panel 262 may include a pressure sensor (or force sensor) capable of measuring the intensity of the pressure on the user's touch. The pressure sensor may be integrated with the touch panel 252 or may be implemented by one or more sensors separate from the touch panel 252. The hologram device 264 shows a stereoscopic image in the air by using interference of light. The projector 266 projects light on a screen to display an image. For example, the screen may be located inside or outside the electronic device 200.

The interface 270 may include, for example, an HDMI 272, a USB 274, an optical interface 276, or a D-sub (D-subminiature) 278. The interface 270 may be included, for example, in the communication interface 170 shown in FIG. 1. Additionally or alternatively, the interface 270 may include, for example, a mobile high-definition link (MEL) interface, an SD card/multi-media card (MMC) interface, or an infrared data association (IrDA) standard interface.

The audio module 280 bi-directionally converts a sound and an electronic signal. At least some components of the audio module 280 may be included in, for example, the input/output interface 150 illustrated in FIG. 1. The audio module 280 processes sound information input or output through, for example, a speaker 282, a receiver 284, an earphone 286, the microphone 288 or the like. The camera module 291 is a device which can photograph a still image and a video.

According to an embodiment, the camera module 291 may include one or more image sensors (for example, a front sensor or a back sensor), an Image Signal Processor (ISP) (not shown) or a flash (for example, an LED or xenon lamp).

The power managing module 295 manages power of the electronic device 200. The power managing module 295 may include, for example, a Power Management Integrated Circuit (PMIC), a charger Integrated Circuit (IC), or a battery or fuel gauge. The PMIC may have a wired and/or wireless charging method. The wireless charging method may include, for example, a magnetic resonance method, a magnetic induction method and an electromagnetic wave method, and additional circuits for wireless charging, for example, circuits such as a coil loop, a resonant circuit, a rectifier or the like may be added. The battery gauge measures, for example, a remaining quantity of the battery 296, or a voltage, a current, or a temperature during charging. The battery 296 may include a rechargeable battery or a solar battery.

The indicator 297 shows particular statuses of the electronic device 201 or a part (for example, the processor 210) of the electronic device 201, for example, a booting status, a message status, a charging status and the like. The motor 298 converts an electrical signal to a mechanical vibration, and can generate vibration, haptic effects, and the like. The electronic device 200 may include a processing unit (for example, GPU) for supporting a module TV. The processing unit for supporting the mobile TV may process, for example, media data according to a standard of Digital Multimedia Broadcasting (DMB), Digital Video Broadcasting (DVB), mediaFlo™ or the like.

Each of the components described in this document may be composed of one or more components, and the name of the component may be changed according to the type of the electronic device. The electronic device according to various embodiments of the present disclosure may include at least one of the above described components, a few of the components may be omitted, or additional components may be further included. Also, some of the components of the electronic device according to various embodiments of the present disclosure may be combined to form a single entity, and thus may equivalently execute functions of the corresponding components before being combined.

Figure 3:
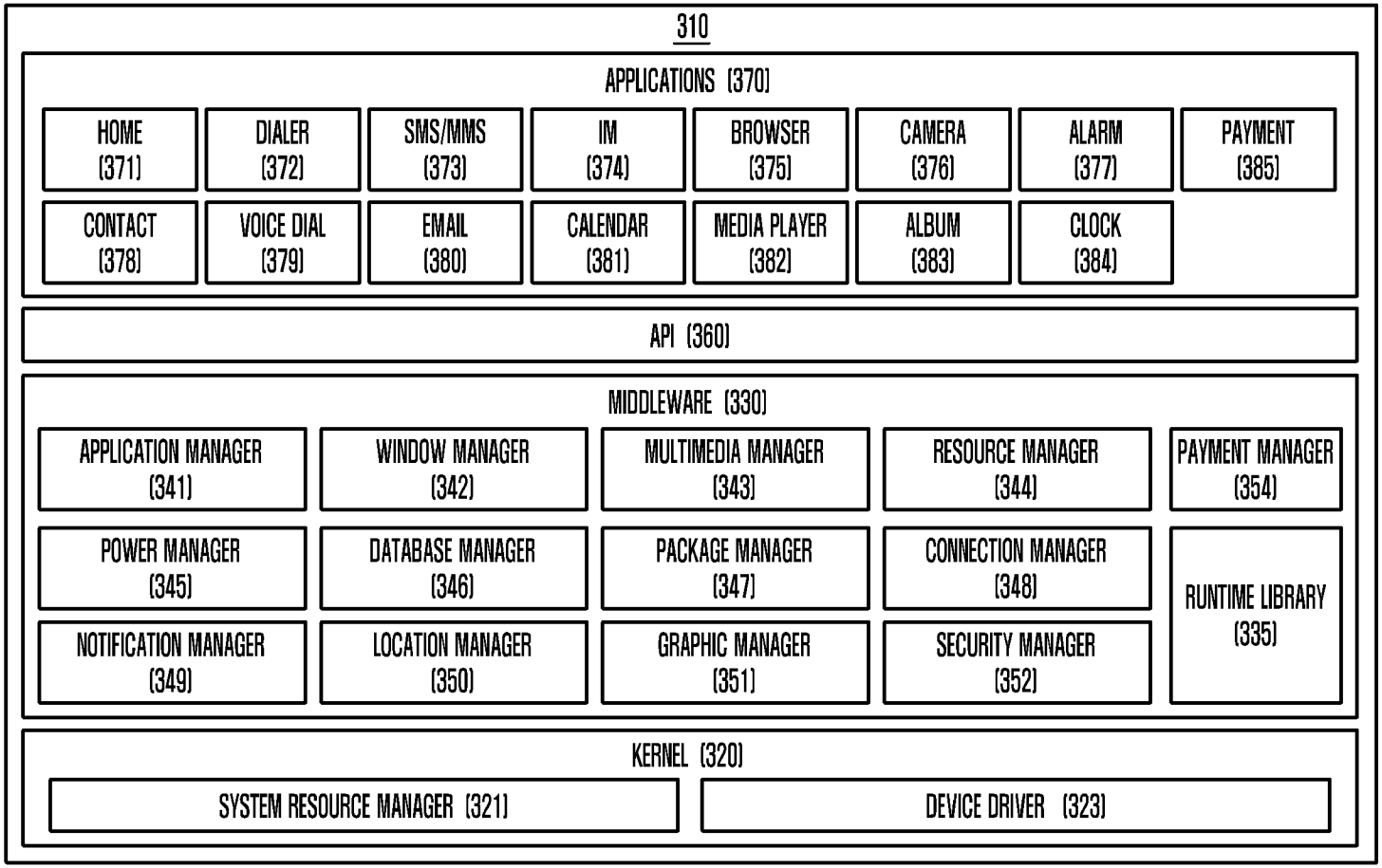
FIG. 3 is a block diagram of a program module according to various embodiments.

FIG. 3 is a block diagram of a programming module according to an embodiment. The programming module 310 may include an Operating System (OS) controlling resources related to the electronic device (for example, electronic device 101) or various applications (for example, applications 370) driving on the OS. For example, the OS may be Android™, iOS™, Windows™, Symbian™, Tizen™, Bada™ or the like.

Referring to FIG. 3, the programming module 310 includes a kernel 320, a middleware 330, an Application Programming Interface (API) 360, and applications 370. At least a portion of the program module 310 is preloaded on the electronic device or downloadable from an external electronic device (e.g., electronic device 102, 104, server 106, etc.).

The kernel 320 (for example, kernel 141) includes a system resource manager 321 and a device driver 323. The system resource manager 321 performs a system resource control, allocation, and recall. According to an embodiment, the system resource manager 321 may include, for example, a process manager, a memory manager, and a file system manager. The device driver 323 may include, for example, a display driver, a camera driver, a Bluetooth driver, a shared memory driver, a USB driver, a keypad driver, a WiFi driver, an audio driver, or an Inter-Process Communication (IPC) driver. The middleware 330 provides various functions through the API 360 to allow the application 370 to provide a function required in common by the applications 370, or use limited system resources within the electronic device. According to an embodiment, the middleware 310 may include at least one of a runtime library 335, an application manager 341, a window manager 342, a multimedia manager 343, a resource manager 344, a power manager 345, a database manager 346, a package manager 347, a connection manager 348, a notification manager 349, a location manager 350, a graphic manager 351, and a security manager 352.

The runtime library 335 may include, for example, a library module used by a complier to add a new function through a programming language while the application 370 is executed. According to an embodiment, the runtime library 335 executes input and output, management of a memory, a function associated with an arithmetic function and the like.

The application manager 341 manages, for example, a life cycle of at least one of the applications 370. The window manager 342 manages GUI resources used on the screen. The multimedia manager 343 detects a format required for reproducing various media files and performs an encoding or a decoding of a media file by using a codec suitable for the corresponding format. The resource manager 344 manages resources such as a source code, a memory, or a storage space of at least one of the applications 370.

The power manager 345 may manage, for example, the capacity or power of the battery and provide the power information necessary for the operation of the electronic device. According to an embodiment, the power manager 345 operates together with a Basic Input/Output System (BIOS) The database manager 346 manages generation, search, and change of a database to be used by at least one of the applications 370. The package manager 347 manages an installation or an update of an application distributed in a form of a package file.

The connection manager 348 manages, for example, a wireless connection. The notification manager 349 displays or notifies a user of an event such as an arrival message, an appointment, a proximity alarm or the like. The location manager 350 may manage, for example, location information of the electronic device. The graphic manager 351 may manage a graphic effect provided to the user or a user interface related to the graphic effect. The security manager 352 provides a general security function required for a system security or a user authentication.

According to an embodiment, the middleware 330 may include a telephony manager for managing a voice of the electronic device or a video call function. The middleware 330 may provide a module specified for each type of operating system to provide a differentiated function. The middleware 330 may dynamically delete some of the conventional components or add new components.

The API 360 (for example, API 145) is a set of API programming functions, and may be provided with a different configuration according to an operating system. For example, in Android or iOS, a single API set may be provided for each platform. In Tizen, two or more API sets may be provided.

The applications 370 may include a home application 371, a dialer application 372, a Short Messaging Service (SMS)/Multimedia Messaging Service (MMS) application 373, an Instant Messaging (IM) application 374, a browser application 375, a camera application 376, an alarm application 377, a contact application 378, a voice dial application 379, an email application 380, a calendar application 381, a media player application 382, an album application 383, a clock application 384, a healthcare (e.g., measuring exercise or blood sugar) application, or an environmental information (e.g., pressure, humidity, or temperature information) application.

According to an embodiment, the application 370 may include an information exchange application capable of supporting the exchange of information between the electronic device and the external electronic device. The information exchange application may include, for example, a notification relay application for communicating specific information to an external electronic device, or a device management application for managing an external electronic device.

For example, the notification relay application may transmit notification information generated in another application of the electronic device to an external electronic device, or may receive notification information from an external electronic device and provide the notification information to the user.

The device management application may, for example, install, delete, or update the functions such as turning on/off the external electronic device itself (or some component) or adjusting the brightness (or resolution) of the display of the external electronic device of an external electronic device that communicates with the electronic device, or an application that operates on the external electronic device.

According to an embodiment, the application 370 may include an application (e.g., a healthcare application of a mobile medical device) designated according to the attributes of the external electronic device. According to an embodiment, the application 370 may include an application received from an external electronic device.

At least some of the program modules 310 may be implemented (e.g., executed) in software, firmware, hardware (e.g., processor 210), or a combination of at least two of the same, and may comprise modules, programs, routines, instruction sets or processes for performing one or more functions.

The term "module" used in the present disclosure may refer to, for example, a unit including one or more combinations of hardware, software, and firmware. The "module" may be interchangeable with a term, such as "unit," "logic," "logical block," "component," "circuit," or the like. The "module" may be a minimum unit of a component formed as one body or a part thereof. The "module" may be a minimum unit for performing one or more functions or a part thereof. The "module" may be implemented mechanically or electronically. For example, the "module" according to an embodiment of the present disclosure may include at least one of an Application-Specific Integrated Circuit (ASIC) chip, a Field-Programmable Gate Array (FPGA), and a programmable-logic device for performing certain operations which have been known or are to be developed in the future.

At least a part of the programming module may be implemented by instructions stored in a non-transitory computer-readable storage medium. When the instructions are executed by one or more processors (e.g., the one or more processors 120), the one or more processors may perform functions corresponding to the instructions. The non-transitory computer-readable storage medium may be, for example, the memory 130.

The computer readable storage media may include magnetic media such as a hard disk and floppy disk, optical media such as a CD-ROM and DVD, magneto-optical media such as a floptical disk, and memory devices. The instructions may include codes produced by compilers and codes executable through interpreters.

A module or program module may include at least one of the components described above. An existing component of the module may be removed or a new component may be added to the module. Operations supported by a module, program module, or another component may be carried out in sequence, in parallel, by repetition, or heuristically. Some operations may be executed in a different order or may be omitted, and a new operation may be added.

Now, an electronic device including a speaker according to various embodiments of the present invention will be described in detail with reference to FIGS. 4 to 11.

Figure 4:
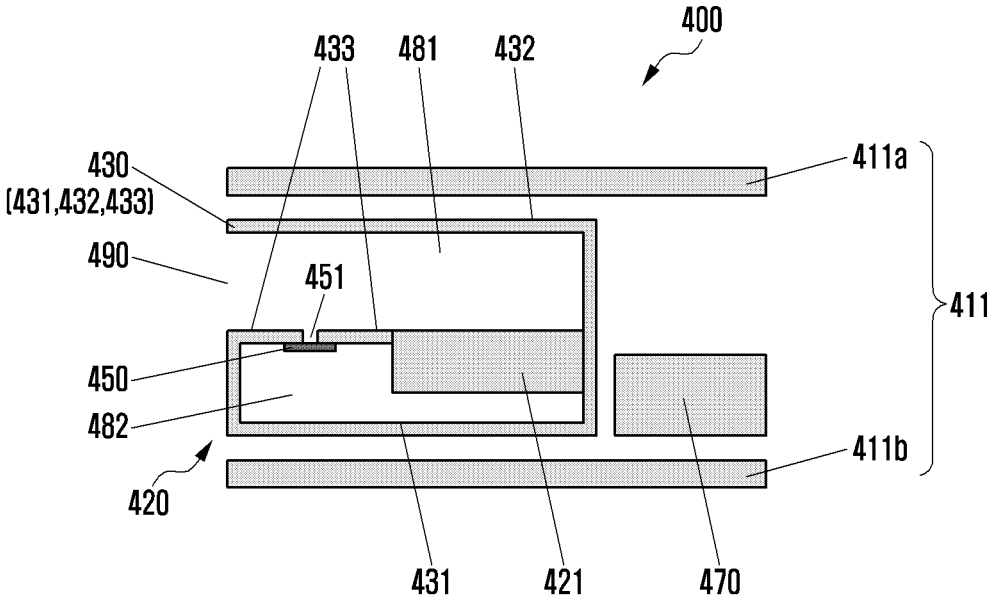
FIG. 4 is a cross-sectional view schematically illustrating an electronic device according to various embodiments.

FIG. 4 is a cross-sectional view schematically illustrating an electronic device 400 according to various embodiments.

Referring to FIG. 4, the electronic device 400 may include a first housing 411 (411*a*, 411*b*) and a second housing 430 (431, 432, 433). That is, a housing 411 (411*a* and 411*b*) of the electronic device 400 may form the first housing, and a housing 430 of a speaker module 420 may form the second housing. The electronic device 400 includes the housing 411 (411*a* and 411*b*) or the first housing, and the first housing 411 may contain the speaker module 420 therein. The electronic device 400 may contain a battery pack, an integrated circuit chip, and the like as well as the speaker module 420 contained in the housing 411 of the electronic device 400. Also, in the housing 411 of the electronic device 400, a structure for isolating the speaker module 420 from other components may be contained.

In FIGS. 4, 411*a* and 411*b* indicate the housing of the electronic device 400, but 411*a* and 411*b* may indicate a circuit board, a display device, or other structure disposed within the housing. In FIG. 4, 470 may indicate a battery pack or an integrated circuit chip.

The speaker module 420 may include a side acoustic emission type speaker device. According to various embodiments, the speaker module 420 may be referred to as a speaker, a speaker device, or the like, and may correspond to any other element that generates a sound in the electronic device 400. In a certain embodiment, the speaker module may include a receiver. However, in the following description, it is assumed that the speaker module 420 includes a speaker and a structure around the speaker.

The speaker module 420 may include a speaker 421 that generates a sound by having a magnetic circuit and a diaphragm, the housing 430 that enclosures, at least in part, the speaker 421 disposed therein, and a speaker hole 490 that is formed at one side of the speaker module 420. The speaker 421 may be formed of a micro speaker. The speaker 421 may include the speaker 282 of FIG. 2. The housing 430 of the speaker module 420 may form the second housing.

The speaker 421 may include a magnetic circuit having a yoke and a magnet in a frame, a voice coil positioned in an air gap of the magnetic circuit, a side diaphragm and a center diaphragm vibrated by the voice coil, a suspension for guiding the movement of the voice coil and the diaphragms, and a terminal pad for receiving an electric signal from the outside to transmit the signal to the voice coil through the suspension.

The speaker module 420 may be configured as a separate type. In an embodiment, the housing 430 (the second housing) of the speaker module 420 may include a first plate 431, a second plate 432, and a third plate 433. The first plate 431 may be positioned under the speaker 421, and the second plate 432 may be positioned above the speaker 421. The second plate 432 may extend, at one end thereof, toward the first plate 431 and meet the first plate 431. Similarly, the first plate 431 may extend, at one end thereof, toward the second plate 432 and meet the second plate 432. The third plate 433 may be disposed between the first plate 431 and the second plate 432 and configured to separate an inner space of the housing 430 into a first space 481 and a second space 482. The speaker module 420 as well as the third plate 433 separates the first space 481 and the second space 482.

The first space 481 may include a space defined by the second plate 432, the speaker 421, and the third plate 433, and the second space 482 may include a space defined by the first plate 431, the speaker 421, and the third plate 433. The first space 481 may spatially communicate with the outside of the housing 430 of the speaker module 420 and with the outside of the housing 411 of the electronic device 400 through the speaker hole 490.

The third plate 433 that separates the first space 481 and the second space 482 may include, at least in part, an opening 451 that connects the first space 481 and the second space 482. A barrier 450 may be attached to the opening 451. In one embodiment, the opening 451 with the barrier 450 attached may block a sound, generated through the speaker 421 and residing in the second space 482, from being transmitted to the first space 481. In another embodiment, the opening 451 with the barrier 450 attached may mostly equalize the atmospheric pressure between the first space 481 and the second space 482. In the speaker module 420 according to various embodiments, the barrier 450 may have a waterproof function. The barrier 450 having the waterproof function may protect the speaker 421 from moisture that may flow in through the speaker hole 490. In one embodiment, the barrier may be formed of a Goretex material.

According to various embodiments of the present invention, an electronic device including a speaker may comprise a first housing; a second housing dispose in an inner space of the first housing and containing the speaker; a separator for separating an inner space of the second housing into a first space residing above an upper surface of the speaker and open to an outside of the second housing, and a second space residing under a lower surface of the speaker; an opening formed in the separator and connecting the first space and the second space; and a barrier attached to the opening, allowing air permeation between the first space and the second space, and having a sound blocking function between the first space and the second space.

According to various embodiments of the present invention, the barrier may further have a waterproof function between the first space and the second space.

According to various embodiments of the present invention, the barrier may be attached to one of a top of the opening or a bottom of the opening.

According to various embodiments of the present invention, the opening may have a stepped structure, and the barrier may be attached to the stepped structure of the opening.

According to various embodiments of the present invention, the second housing may include a first plate facing the lower surface of the speaker, a second plate facing the upper surface of the speaker, and a third plate as the separator.

According to various embodiments of the present invention, the third plate may have one end being in contact with a first side surface of the speaker, and an opposite end extending in a direction of the speaker hole and being in contact with the first plate.

According to various embodiments of the present invention, at least a portion of the first plate may be connected to at least a portion of the third plate, thereby the first and third plates having an integrated form.

According to various embodiments of the present invention, the separator may include a fourth plate as a sub-separator.

According to various embodiments of the present invention, the fourth plate may include a protrusion extending from the second plate and being in contact with a second side surface of the speaker being opposite to the first side surface.

According to various embodiments of the present invention, the first space may include a space formed between the upper surface of the speaker and the second plate, and a space formed between the third plate and the second plate.

According to various embodiments of the present invention, the second space may include a space formed between the first plate and a portion of the second plate extending from the protrusion and being in contact with the first plate, a space formed between the lower surface of the speaker and the first plate, and a space formed between the first plate and the third plate.

According to various embodiments of the present invention, the speaker may include a speaker having a waterproof function.

Hereinafter, a speaker module according to various embodiments of this disclosure will be described in more detail.

Figure 5:
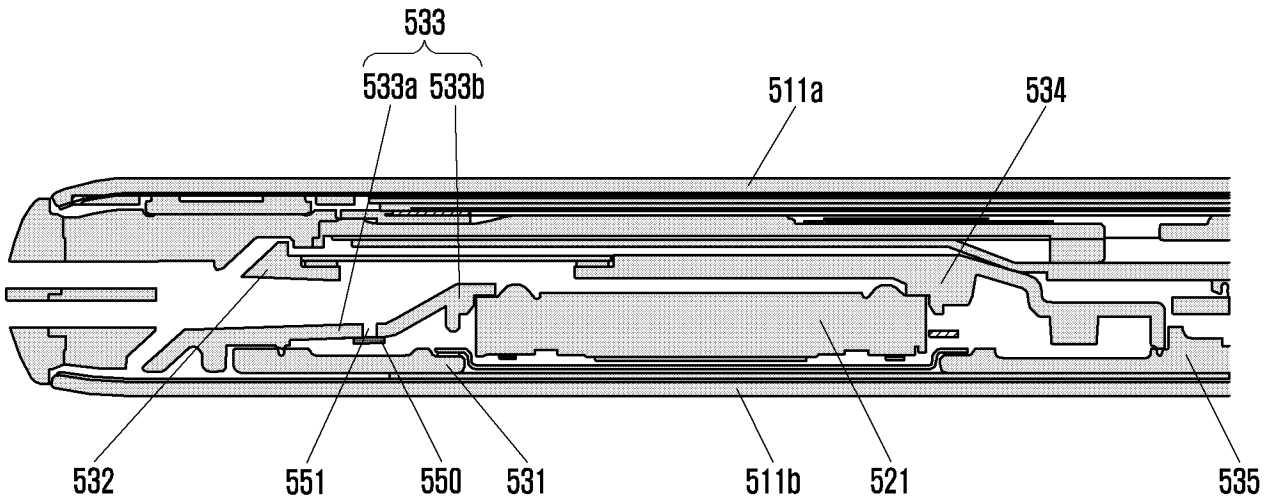
FIG. 5 is a cross-sectional view illustrating a part of an electronic device according to various embodiments.

FIG. 5 is a cross-sectional view illustrating a part of an electronic device according to various embodiments.

Referring to FIG. 5, the electronic device may include a housing 511*a* and 511*b* thereof and a speaker module contained in the housing 511*a* and 511*b*. A hole may be formed on at least one side of the housing 511*a* and 511*b* of the electronic device. The hole may communicate with a speaker hole of a housing 531, 532, 533, 534 and 535 of the speaker module. The housing 511*a* and 511*b* of the electronic device may form a first housing, and the housing 531, 532, 533, 534 and 535 of the speaker module may form a second housing.

The housing 511*a* and 511*b* of the electronic device may be composed of a front case 511*a* and a rear case 511*b*. In a space between the front case 511*a* and the rear case 511*b*, the housing 531, 532, 533, 534 and 535 of the speaker module, i.e., a first plate 531, a second plate 532, a third plate 533, a fourth plate 534, and a fifth plate 533 may be contained. In one embodiment, the fourth plate 534 may be a protrusion of the second plate 532. In one embodiment, a portion of the second plate 532 and a portion of the third plate 533 may be connected to each other as an integrated form. The fifth plate 535 may be integrated with the first plate 531. In one embodiment, the fifth plate 535 may be combined with the first plate 531 through a metal plate or an injected product. The first plate 531 of the housing of the speaker module may be disposed near the inner surface of the rear case 511*b* of the housing of the electronic device. A speaker 521 may be disposed above the first plate 531. The first plate 531 may be formed of a metal plate, an injected product, or a combination thereof.

The second plate 532 may be disposed near the inner surface of the front case 511*a* of the housing of the electronic device. The second plate 532 may be formed of a metal plate, an injected product, or a combination thereof. The second plate 532 may be disposed above the speaker 521, and a portion of the second plate 532 may be in contact with at least one of an upper surface and a side surface of the speaker 521. In one embodiment, a portion of the second plate 532 may be placed on the speaker 521. A portion of the second plate 532 protrudes to form a protrusion and may be placed on the speaker 521. As a portion of the second plate 532 is in contact with and/or is placed on the speaker 521, a waterproof effect is produced. A portion of the second plate 532 is defined as the fourth plate 534. In one embodiment, such a contact and/or placed portion of the second plate may prevent the inflow of moisture toward the speaker 521. In another embodiment, such a contact portion of the second plate may be packed with an adhesive and/or material having a waterproof function.

An opening 551 may be formed in a part of the third plate 533 of the housing of the speaker module. The opening 551 separates the third plate 533 into a first sub-plate 533*a* and a second sub-plate 533*b*. The third plate 533 may be formed of a metal plate, an injected product, or a combination thereof. A barrier 550 capable of sound blocking and air permeation may be attached to the opening 551. In another embodiment, the barrier 550 attached to the opening 551 may be capable of waterproof as well as sound blocking and air permeation.

The first sub-plate 533*a* of the third plate 533 may be in contact with the first plate 531, and the second sub-plate 533*b* of the third plate 533 may be in contact with at least one of the upper surface and the side surface of the speaker 521. In one embodiment, the second sub-plate 533*b* of the third plate 533 may be placed on the speaker 521. As the second sub-plate 533*b* of the third plate 533 is in contact with and/or placed on the speaker 521, a waterproof effect is produced. In one embodiment, the second sub-plate 533*b* of the third plate may prevent the inflow of moisture toward the speaker 521. In another embodiment, the second sub-plate 533*b* of the third plate may be packed with an adhesive and/or material having a waterproof function.

When the first sub-plate 533*a* of the third plate 533 is in contact with the first plate 531, and also the second sub-plate 533*b* of the third plate 533 is placed on the speaker 521, a space is formed between the third plate 533 and the second plate 532. This space is defined as a first space.

When the first sub-plate 533*a* of the third plate 533 is in contact with the first plate 531, and also the second sub-plate 533*b* of the third plate 533 is placed on the speaker 521, a space is also formed between the third plate 533 and the first plate 531. This space is defined as a second space.

In one embodiment, the hole formed on one side of the housing 511*a* and 511*b* of the electronic device communicates with the speaker hole of the speaker module, so that the speaker module can be spatially connected to the outside of the electronic device. In one embodiment, the first space of the speaker module may be spatially connected to the outside of the electronic device.

In a housing structure of a speaker module according to various embodiments of the present invention, a sound generated from the speaker goes out to the outside, as follows.

Figure 6:
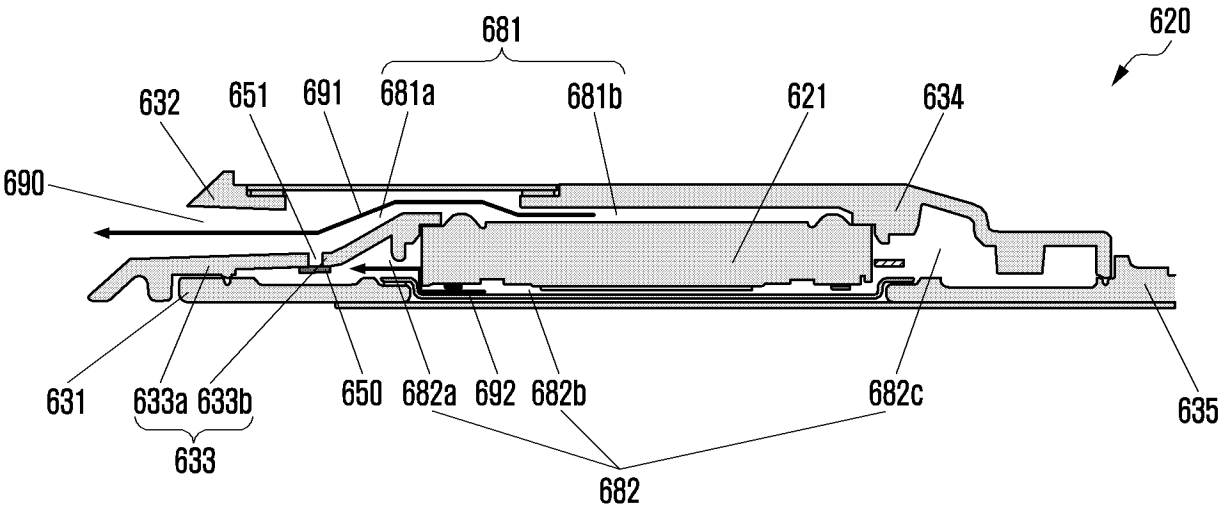
FIG. 6 is a cross-sectional view illustrating a speaker module according to various embodiments.

FIG. 6 is a cross-sectional view illustrating a speaker module 620 according to various embodiments.

Referring to FIG. 6, a speaker hole 690 may be formed on one side of a housing 631, 632, 633, 634 and 635 of the speaker module 620. The speaker hole 690 communicates with a hole of a housing of an electronic device in which the speaker module 620 is mounted, and may be exposed to the outside of the electronic device. The housing 631, 632, 633, 634 and 635 of the speaker module may form a second housing.

The housing 631, 632, 633, 634 and 635 of the speaker module 620 may include a first plate 631, a second plate 632, a third plate 633, a fourth plate 634, and a fifth plate 635. In one embodiment, the fourth plate 634 may be a protrusion of the second plate 632. In one embodiment, a portion of the second plate 632 and a portion of the third plate 633 may be connected to each other as an integrated form. The fifth plate 635 may be integrated with the first plate 631. In one embodiment, the fifth plate 635 may be combined with the first plate 631 through a metal plate or an injected product.

The first plate 631 to the fifth plate 635 may be formed of a metal plate, an injected product, or a combination thereof.

The first place 631 may be disposed under a speaker 621. The second plate 632 may be disposed above the speaker 621. A portion of the second plate 632 may be in contact with at least one of an upper surface and a side surface of the speaker 621. In one embodiment, a portion of the second plate 632 may be placed on the speaker 621. In another embodiment, a portion of the second plate 632 protrudes to form a protrusion and may be placed on the speaker 621. As a portion of the second plate 632 is in contact with and/or is placed on the speaker 621, a waterproof effect is produced. The protrusion is defined as the fourth plate 634. Also, the fourth plate 634 may be defined as the protrusion protruding from the second plate 632 and a portion of the second plate 632 extending to be in contact with the first plate 631. In one embodiment, as the fourth plate 634 is in contact with or is placed on the speaker 621, the contact or placed portion may prevent the inflow of moisture. In another embodiment, such a contact portion of the fourth plate 634 may be packed with an adhesive and/or material having a waterproof function.

An opening 651 may be formed in a part of the third plate 633 of the housing of the speaker module 620. The opening 651 separates the third plate 633 into a first sub-plate 633*a* and a second sub-plate 633*b*. A barrier 650 capable of sound blocking and air permeation may be attached to the opening 651.

The first sub-plate 633*a* of the third plate 633 may be in contact with the first plate 631, and the second sub-plate 633*b* of the third plate 633 may be in contact with at least one of the upper surface and the side surface of the speaker 621. In one embodiment, the second sub-plate 633*b* of the third plate 633 may be placed on the speaker 621. As the second sub-plate 633*b* of the third plate 633 is in contact with and/or placed on the speaker 621, a waterproof effect is produced. In one embodiment, the second sub-plate 633*b* of the third plate may prevent the inflow of moisture toward the speaker 621. In another embodiment, the second sub-plate 633*b* of the third plate may be packed with an adhesive and/or material having a waterproof function.

When the first sub-plate 633*a* of the third plate 633 is in contact with the first plate 631, and also the second sub-plate 633*b* of the third plate 633 is placed on the speaker 621, a space 681*a* is formed between the third plate 633 and the second plate 632. This space 681*a* is defined as a part of a first space 681. The first space 681 may include the space 681*a* formed between the third plate 633 and the second plate 632, and a space 681*b* formed between an inner surface of the second plate 632 and an upper surface of the speaker 621.

When the first sub-plate 633*a* of the third plate 633 is in contact with the first plate 631, and also the second sub-plate 633*b* of the third plate 633 is placed on the speaker 621, a space 682*a* is formed between the third plate 633 and the first plate 631. This space is defined as a part of a second space 682. The second space 682 may include the space 682*a* formed between the third plate 633 and the first plate 631, a space 682*b* formed between a lower surface of the speaker 621 and the first plate 631, and a space 682*c* formed between the fourth plate 634 and the fifth plate 635. The fourth plate 634 may mean a protrusion protruding from the second plate 632 and a portion of the second plate 632 extending to be in contact with the first plate 631.

In one embodiment, the hole formed on one side of the housing of the electronic device communicates with the speaker hole 690 of the speaker module 620, so that the speaker module 620 may be spatially connected to the outside of the electronic device. In one embodiment, the first space 681 of the speaker module 620 may be spatially connected to the outside of the electronic device. Also, a diaphragm of the speaker 621 may be exposed to the first space 681. According to structural characteristics of the speaker 621, the diaphragm vibrates up and down. Therefore, there may be a sound generated into the first space 681 and a sound generated into the second space 682. The sound generated into the first space 681 from the diaphragm may be output to the speaker hole 690 through the first space 681. This sound output route is shown by an arrow 691 in FIG. 6. On the other hand, the sound generated into the second space 682 from the diaphragm of the speaker 621 resides in the second space 682 and is blocked by a barrier 650 attached to an opening 651 formed in the third plate 633. Thus, this sound may not proceed to the first space 681. The sound generated into the first space 681 and the sound generated into the second space 682 are opposite in phase. Therefore, if both sounds meet, such sounds may be canceled or an abnormal sound may be generated. This undesirable phenomenon is prevented by the barrier. The route of the sound generated into the second space 682 is shown by an arrow 692 in FIG. 6.

The opening 651 and the barrier 650 attached to the opening 651 have features of passing air but blocking sound. According to one embodiment, in an environment where the atmospheric pressure changes abruptly in the speaker module 620, it is possible to prevent a change in the atmospheric pressure from affecting the diaphragm of the speaker 621.

In a housing structure of a speaker module according to various embodiments of the present invention, moisture introduced from the outside is blocked, as follows.

Figure 7:
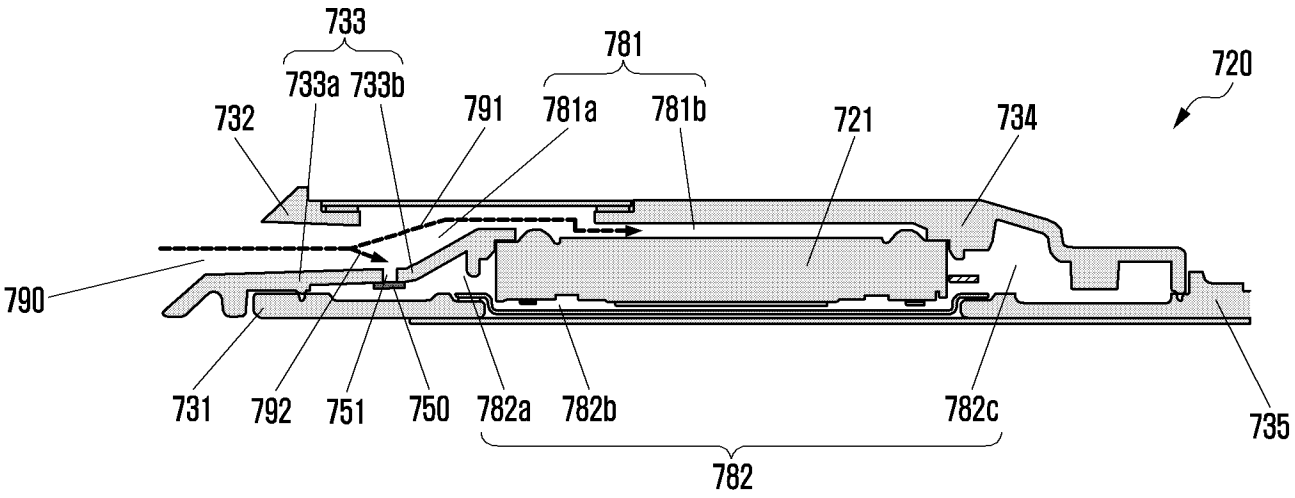
FIG. 7 is a cross-sectional view illustrating a speaker module according to various embodiments.

FIG. 7 is a cross-sectional view illustrating a speaker module according to various embodiments.

Referring to FIG. 7, a speaker hole 790 may be formed on one side of a housing 731, 732, 733, 734 and 735 of the speaker module 720. The speaker hole 790 communicates with a hole of a housing of an electronic device in which the speaker module 720 is mounted, and may be exposed to the outside of the electronic device. The housing 731, 732, 733, 734 and 735 of the speaker module may form a second housing.

The housing 731, 732, 733, 734 and 735 of the speaker module 720 may include a first plate 731, a second plate 732, a third plate 733 (733*a* and 733*b*), a fourth plate 734, and a fifth plate 735. In one embodiment, the fourth plate 734 may be a protrusion of the second plate 732. In one embodiment, a portion of the second plate 732 and a portion of the third plate 733 (733*a* and 733*b*) may be connected to each other as an integrated form. The fifth plate 735 may be integrated with the first plate 731. In one embodiment, the fifth plate 735 may be combined with the first plate 731 through a metal plate or an injected product.

The first plate 731 to the fifth plate 735 may be formed of a metal plate, an injected product, or a combination thereof.

The first place 731 may be disposed under a speaker 721. The second plate 732 may be disposed above the speaker 721. A portion of the second plate 732 may be in contact with at least one of an upper surface and a side surface of the speaker 721. In one embodiment, a portion of the second plate 732 may be placed on the speaker 721. In another embodiment, a portion of the second plate 732 protrudes to form a protrusion and may be placed on the speaker 721. As a portion of the second plate 732 is in contact with and/or is placed on the speaker 721, a waterproof effect is produced. The protrusion is defined as the fourth plate 734. Also, the fourth plate 734 may be defined as the protrusion protruding from the second plate 732 and a portion of the second plate 732 extending to be in contact with the first plate 731. In one embodiment, as the fourth plate 734 is in contact with or is placed on the speaker 721, the contact or placed portion may prevent the inflow of moisture. In another embodiment, such a contact portion of the fourth plate 734 may be packed with an adhesive and/or material having a waterproof function.

An opening 751 may be formed in a part of the third plate 733 (733*a* and 733*b*) of the housing of the speaker module 720. The opening 751 separates the third plate 733 into a first sub-plate 733*a* and a second sub-plate 733*b*. A barrier 750 capable of sound blocking and air permeation may be attached to the opening 751.

The first sub-plate 733*a* of the third plate 733 may be in contact with the first plate 731, and the second sub-plate 733*b* of the third plate 733 may be in contact with at least one of the upper surface and the side surface of the speaker 721. In one embodiment, the second sub-plate 733*b* of the third plate 733 may be placed on the speaker 721. As the second sub-plate 733*b* of the third plate 733 is in contact with and/or placed on the speaker 721, a waterproof effect is produced. In one embodiment, the second sub-plate 733*b* of the third plate may prevent the inflow of moisture toward the speaker 721. In another embodiment, the second sub-plate 733*b* of the third plate may be packed with an adhesive and/or material having a waterproof function.

When the first sub-plate 733*a* of the third plate 733 is in contact with the first plate 731, and also the second sub-plate 733*b* of the third plate 733 is placed on the speaker 721, a space 781*a* is formed between the third plate 733 and the second plate 732. This space 781*a* is defined as a part of a first space 781. The first space 781 may include the space 781*a* formed between the third plate 733 and the second plate 732, and a space 781*b* formed between an inner surface of the second plate 732 and an upper surface of the speaker 721.

When the first sub-plate 733*a* of the third plate 733 is in contact with the first plate 731, and also the second sub-plate 733*b* of the third plate 733 is placed on the speaker 721, a space 782*a* is formed between the third plate 733 and the first plate 731. This space is defined as a part of a second space 782. The second space 782 may include the space 782*a* formed between the third plate 733 and the first plate 731, a space 782*b* formed between a lower surface of the speaker 721 and the first plate 731, and a space 782*c* formed between the fourth plate 734 and the fifth plate 735. The fourth plate 734 may mean a protrusion protruding from the second plate 732 and a portion of the second plate 732 extending to be in contact with the first plate 731.

In one embodiment, the hole formed on one side of the housing of the electronic device communicates with the speaker hole 790 of the speaker module 720, so that the speaker module 720 may be spatially connected to the outside of the electronic device. In one embodiment, the first space 781 of the speaker module 720 may be spatially connected to the outside of the electronic device. Also, a diaphragm of the speaker 721 may be exposed to the first space 781. The surface of the speaker 721 may be waterproofed.

Moisture may be introduced into the first apace 781 through the speaker hole 790. According to structural characteristics of the speaker 721, such moisture introduced through the speaker hole 790 flows along the upper surface of the speaker 721 in the first space 781 and also is heading for the second space 782. The moisture that flows along the upper surface of the speaker 721 is shown by an arrow 791. The moisture that is heading for the second space 782 is shown by an arrow 792.

Even if the moisture flows toward the upper surface of the speaker 721, this moisture may not affect the function of the speaker 721 because the upper surface of the speaker 721 is waterproofed. On the other hand, the lower surface of the speaker 721 mounted on the first plate 731 includes electrical wiring and thus is not waterproofed. Therefore, the moisture heading for the second space 782 and the lower surface of the speaker 721 may affect the function of the speaker 721. In one embodiment, the barrier 750 attached to the opening 751 of the third plate 733 may block the moisture heading for the lower surface of the speaker 721 through the second space 782. The opening 751 and the barrier 750 attached to the opening 751 have waterproof and soundproof properties while having an air permeation function. According to one embodiment, in an environment where the atmospheric pressure suddenly changes in the speaker module 720 and also moisture permeates the speaker module 720, the barrier 750 attached to the opening 751 in the speaker module 720 not only prevents a change in the atmospheric pressure from affecting the diaphragm of the speaker 721, but also prevents the moisture flowing into the speaker module 720 from affecting the function of the speaker.

According to various embodiments of the present invention, the above-described barrier may have various forms as follows so as to block the inflow of moisture and also maintain the atmospheric pressure inside the speaker module to be similar with the atmospheric pressure outside the electronic device.

FIGS. 8A to 8E are cross-sectional views illustrating a part of a speaker module with an attached barrier according to various embodiments.

FIGS. 8A to 8E show that an opening is punched in a third plate 833*a* and 833*b* and a barrier 850 is attached to the opening. The third plate may be separated into a first sub-plate 833*a* and a second sub-plate 833*b* by the opening formed therein. There may be various cases where the barrier 850 is attached to the opening formed between the first sub-plate 833*a* and the second sub-plate 833*b*. One surface of the first sub-plate 833*a* of the third plate may be formed of a stepped structure. In one embodiment, the upper surface or the lower surface of the first sub-plate 833*a* may have a stepped structure. The stepped structure may mean a structure formed of two planes with different levels. In one embodiment, the barrier 850 may be attached to both the first sub-plate 833*a* and the second sub-plate 833*b* of the third plate through an adhesive having a waterproof function. In another embodiment, when the barrier 850 is attached to the first sub-plate 833*a* and the second sub-plate 833*b* of the third plate, the barrier may be packed with a material having a waterproof function.

Figure 8A:
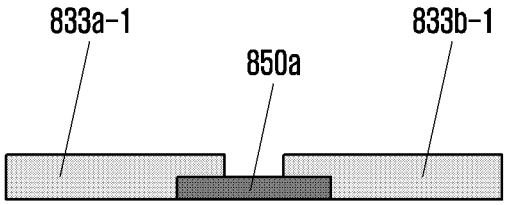
FIGS. 8A to 8E are cross-sectional views illustrating a part of a speaker module with an attached material according to various embodiments.

FIG. 8A shows the first sub-plate 833*a*-1 and the second sub-plate 833*b*-1 which is symmetrical with each other and have a lower surface formed of a stepped structure. The barrier 850*a* may be simultaneously attached to the stepped structure on both the lower surface of the first sub-plate 833*a*-1 and the lower surface of the second sub-plate 833*b*-1.

Figure 8B:
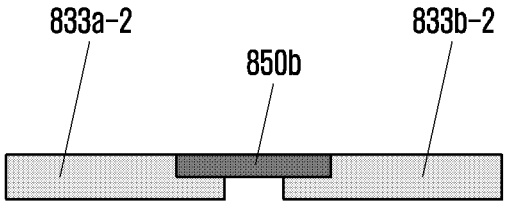

FIG. 8B shows the first sub-plate 833*a*-2 and the second sub-plate 833*b*-2 which is symmetrical with each other and have an upper surface formed of a stepped structure. The barrier 850*b* may be simultaneously attached to the stepped structure on both the upper surface of the first sub-plate 833*a*-2 and the upper surface of the second sub-plate 833*b*-2.

Figure 8C:
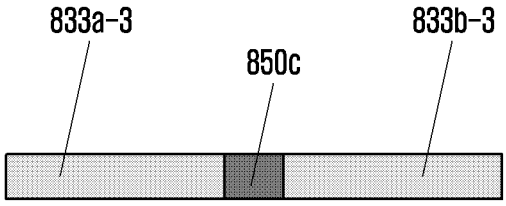

FIG. 8C shows the first sub-plate 833*a*-3 and the second sub-plate 833*b*-3 which have side surfaces facing each other. The barrier 850*c* may be simultaneously attached to both the side surface of the first sub-plate 833*a*-3 and the side surface of the second sub-plate 833*b*-3.

Figure 8D:
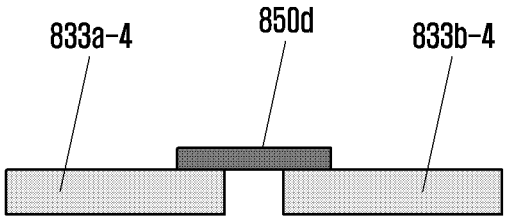

FIG. 8D shows the first sub-plate 833*a*-4 and the second sub-plate 833*b*-4. The barrier 850*d* may be simultaneously attached to both the upper surface of the first sub-plate 833*a*-4 and the upper surface of the second sub-plate 833*b*-4.

Figure 8E:
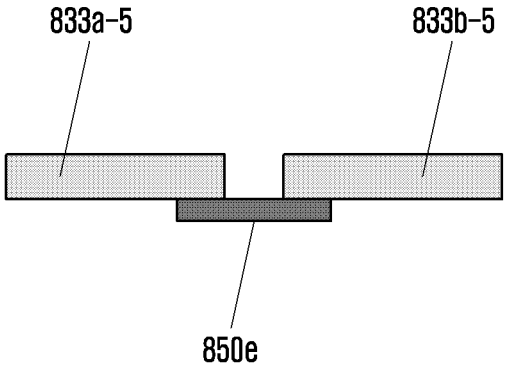

FIG. 8E shows the first sub-plate 833*a*-5 and the second sub-plate 833*b*-5. The barrier 850*e* may be simultaneously attached to both the lower surface of the first sub-plate 833*a*-5 and the lower surface of the second sub-plate 833*b*-5.

FIGS. 9 to 13 are graphs showing acoustic performance of a speaker module with an attached barrier according to various embodiments.

In the electronic device according to various embodiments of the present invention, the opening is punctured in the speaker module as describe above, and the barrier attached to the opening not only allows air permeation but also has a sound blocking function.

FIGS. 9 to 13 show experimental data obtained by comparing the acoustic performance of the electronic device having the speaker module according to various embodiments of the present invention with the acoustic performance of the electronic device having a typical speaker module. Through such comparison, it can be seen that the electronic device according to various embodiments of the present invention, even though the speaker module thereof has the opening with the barrier attached, exhibits similar performance as the typical electronic device. In FIGS. 9 to 13, 'Ref' means a typical electronic device that includes a speaker module with no opening and no barrier. In addition, 'Improved' means the electronic device that includes the speaker module in which the opening is formed and the barrier is attached to the opening.

Figure 9:
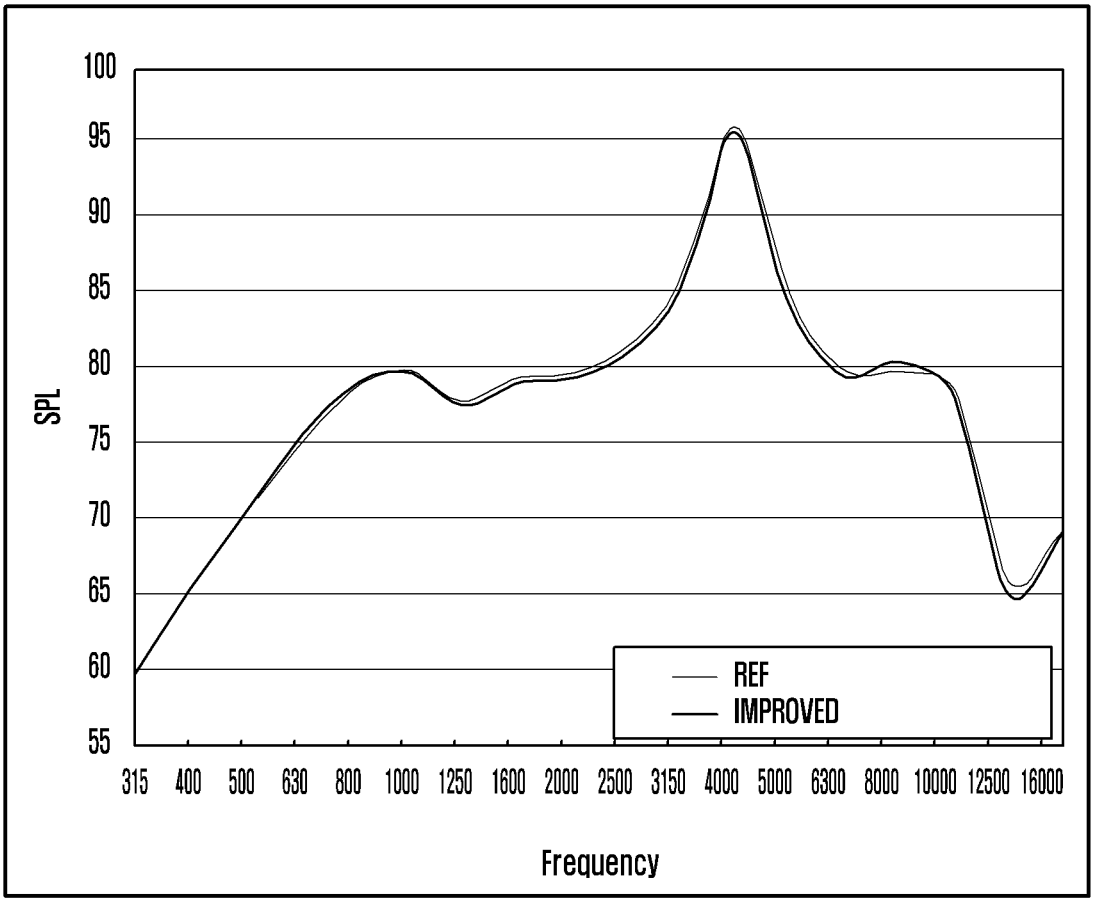
FIGS. 9 to 13 are graphs showing acoustic performance of a speaker module with an attached material according to various embodiments.

FIG. 9 is a graph showing the sound pressure level (SPL) (db) of both electronic devices and a table showing an average sound pressure and a sound pressure difference in a specific frequency band. The SPL refers to the efficiency of the speaker that converts an electric signal into a sound. It can be seen that the SPL measured in the improved electronic device is very similar to the SPL measured in the typical electronic device. As can be seen from the table shown in FIG. 9, the average output sound pressure levels of 0.8, 1, 1.2, and 1.5 kHz are 79 dB and 78.9 dB which are very similar. In addition, it can be seen that the sound pressure of a low frequency band and the sound pressure of a mid/high frequency band merely have differences of 0.1 dB and 0.3 dB, respectively.

Figure 10:
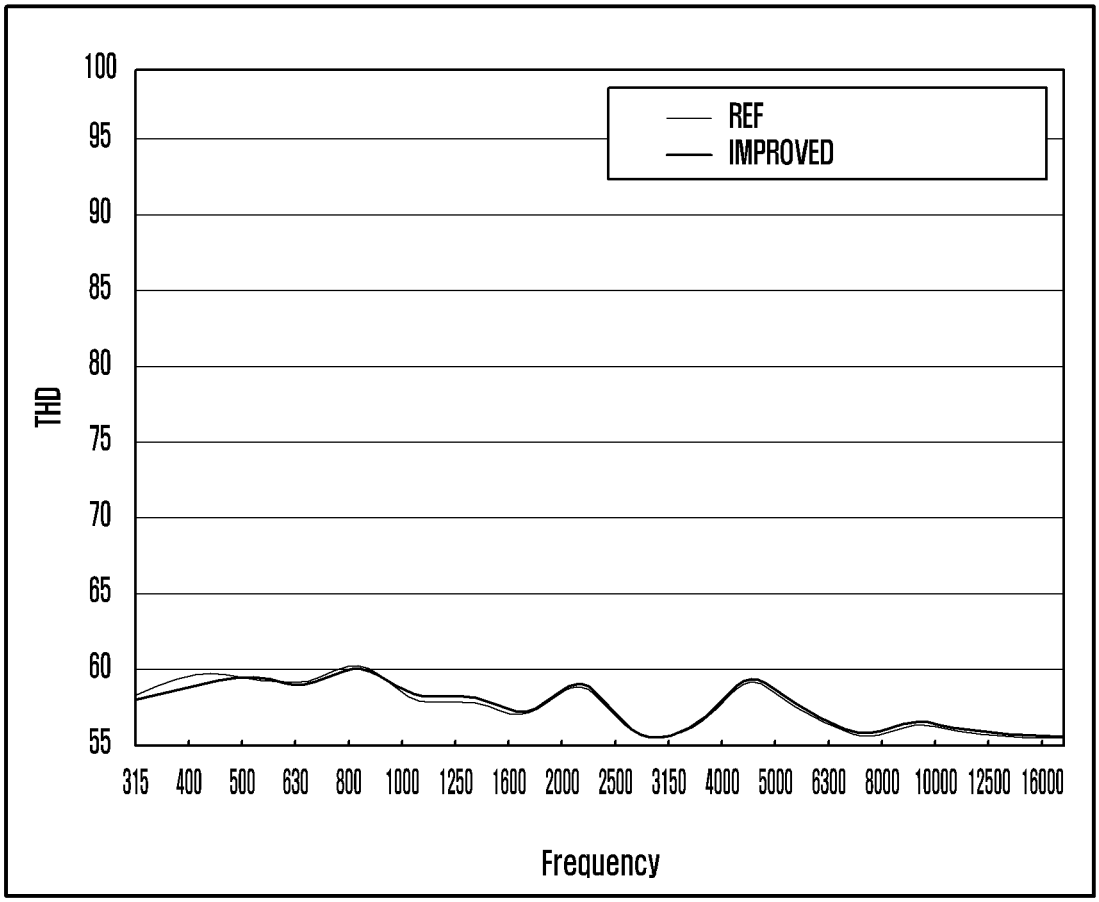

FIG. 10 is a graph showing the harmonic distortion of both electronic devices. The harmonic distortion refers to a distortion caused by the occurrence of unnecessary harmonic components in an audio signal. As a distortion rate, THD (%), is low, this means that a clean sound is reproduced. As can be seen from the graph shown in FIG. 10, the THD measured in the improved electronic device is very similar to the THD measured in the typical electronic device.

Figure 11:
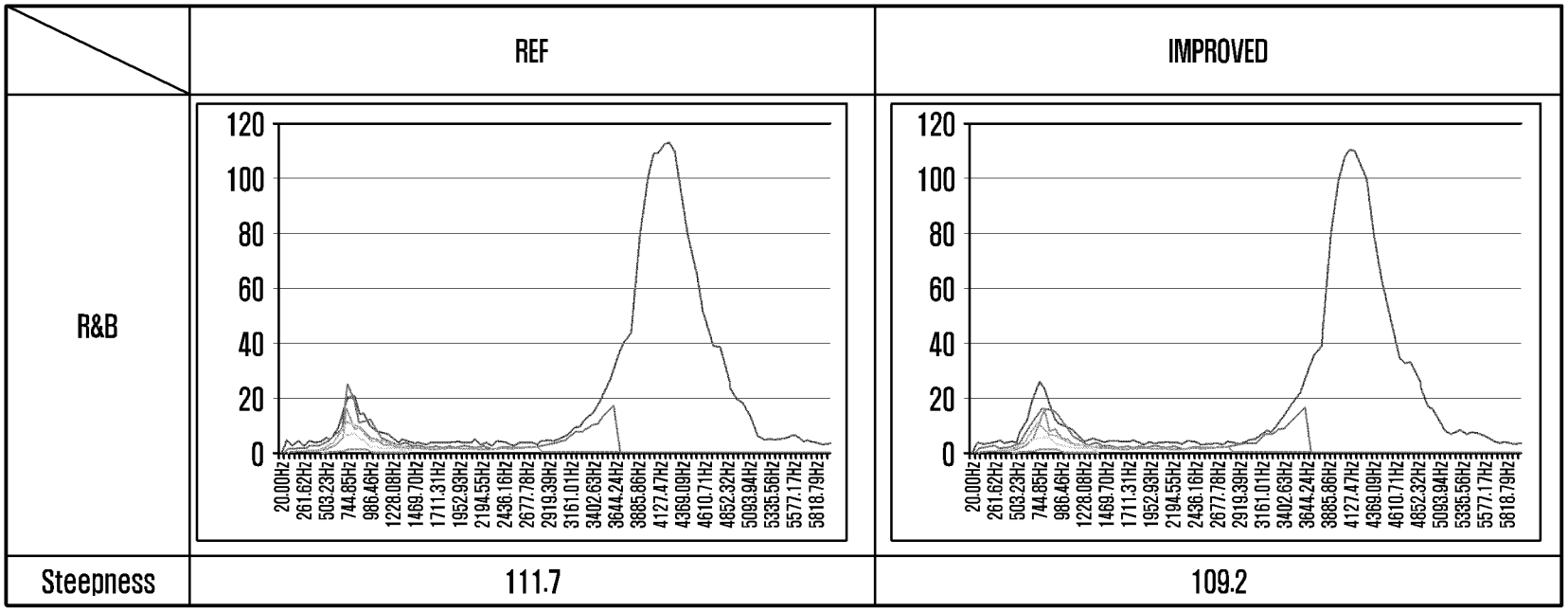

FIG. 11 is a graph showing the R&B of each electronic device and a table showing the steepness value of each electronic device. The R&B refers to Rub and Buzz, which may be measured to determine an abnormal sound of the speaker. The steepness indicates the value of the steepest point on the graph during the R&B measurement. From the experimental graph of FIG. 11, it can be seen that the R&B values of the two electronic devices are similar and also the steepness values are similar.

Figure 12:
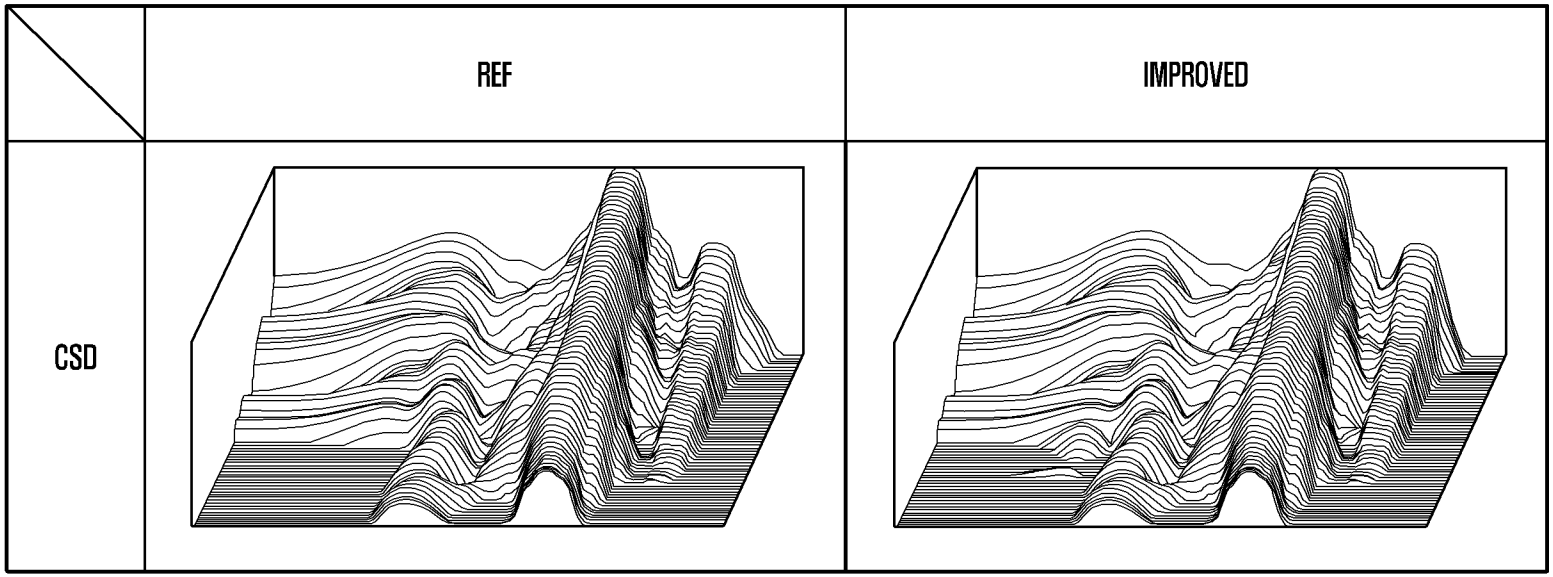

FIG. 12 is a graph showing the cumulative spectral decay (CSD) of each electronic device. The CSD may indicate how fast the speaker diaphragm is stopped when the audio signal is interrupted. From the experimental graph of FIG. 12, it can be seen that the degree of CSD of the two electronic devices is similar.

Figure 13:
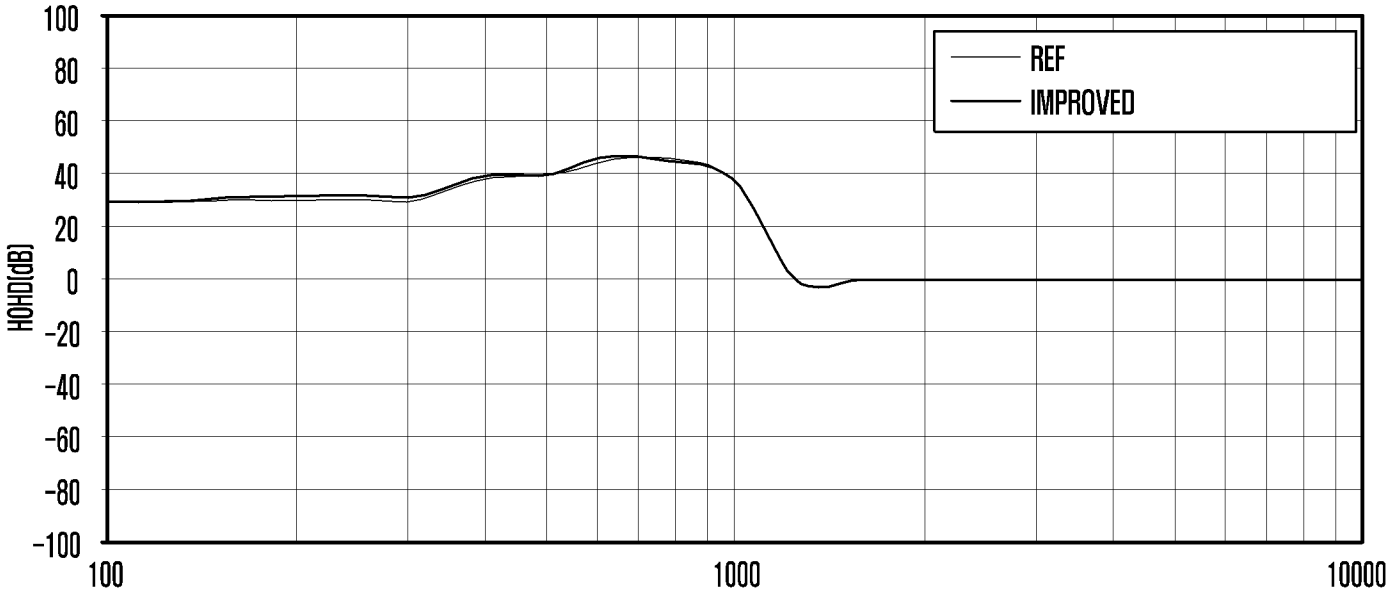

FIG. 13 is a graph showing the high order harmonic distortion (HOHD) of each electronic device. The HOHD is similar to the above-mentioned THD shown in FIG. 10 in view of the experiment of measuring distortion, but the HOHD can check the distortion of the audio signal more precisely than the THD. From the experimental graph of FIG. 13, it can be seen that the degree of HOHD of the two electronic devices is similar.

From the experimental graphs of FIGS. 9 to 13, the speaker module of the electronic device according to various embodiments of the present invention, even though having the opening with the barrier attached, can exhibit the performance similar to that of the typical electronic device having no opening.

While this disclosure contains many specific implementation details, these should not be construed as limitations on the scope of the disclosure or of what may be claimed, but rather as descriptions of features that may be specific to particular embodiments of particular disclosure.

The invention claimed is:

1. An electronic device including a speaker, comprising:

a first housing;

a second housing dispose in an inner space of the first housing and containing the speaker;

a separator for separating an inner space of the second housing into a first space residing above an upper surface of the speaker and open to an outside of the second housing, and a second space residing under a lower surface of the speaker;

an opening formed in the separator and connecting the first space and the second space; and a barrier attached to the opening, allowing air permeation between the first space and the second space, and having a sound blocking function between the first space and the second space, wherein the second housing includes a first plate disposed at least partly below the speaker, a second plate disposed above the speaker, and a third plate as the separator.

2. The electronic device of claim 1, wherein the barrier further has a waterproof function between the first space and the second space.

3. The electronic device of claim 1, wherein the barrier is attached to one of a top of the opening or a bottom of the opening.

4. The electronic device of claim 1, wherein the opening has a stepped structure, and wherein the barrier is attached to the stepped structure of the opening.

5. The electronic device of claim 1, wherein the third plate has one end being in contact with a first side surface of the speaker, and an opposite end extending in a direction of a speaker hole and being in contact with the first plate.

6. The electronic device of claim 1, wherein at least a portion of the first plate is connected to at least a portion of the third plate, thereby the first and third plates having an integrated form.

7. The electronic device of claim 1, wherein the separator includes a fourth plate as a sub-separator.

8. The electronic device of claim 7, wherein the fourth plate includes a protrusion extending from the second plate and being in contact with a second side surface of the speaker being opposite to a first side surface.

9. The electronic device of claim 1, wherein the first space includes:

a space formed between the upper surface of the speaker and the second plate; and a space formed between the third plate and the second plate.

10. The electronic device of claim 1, wherein the second space includes:

a space formed between the first plate and a portion of the second plate extending from a protrusion and being in contact with the first plate;

a space formed between the lower surface of the speaker and the first plate; and a space formed between the first plate and the third plate.

11. The electronic device of claim 1, wherein the speaker includes a speaker having a waterproof function.

* * * * *